United States Patent [19]

Kosfeld

[11] Patent Number: 4,850,816

[45] Date of Patent: Jul. 25, 1989

[54] REFRIGERANT GAS COMPRESSOR UNIT

[75] Inventor: Milton M. Kosfeld, Bristol, Tenn.

[73] Assignee: Bristol Compressors, Inc., Bristol, Va.

[21] Appl. No.: 214,116

[22] Filed: Jun. 30, 1988

[51] Int. Cl.[4] ..... F04B 39/04

[52] U.S. Cl. ..... 417/313; 417/366; 417/902

[58] Field of Search ..... 417/312, 313, 366, 902; 62/296; 184/6.23

[56] References Cited

U.S. PATENT DOCUMENTS

| | | | |
|---|---|---|---|
| 4,147,479 | 4/1979 | Morse | 417/902 X |
| 4,470,772 | 9/1984 | Gannaway | 417/902 X |
| 4,486,153 | 12/1984 | Romer et al. | 417/313 |

FOREIGN PATENT DOCUMENTS

| | | | |
|---|---|---|---|
| 60-119397 | 6/1985 | Japan | 417/366 |

*Primary Examiner*—Carlton R. Croyle
*Assistant Examiner*—Eugene L. Szczecina, Jr.

[57] ABSTRACT

A refrigeration gas compressor unit having a casing, and electric motor driven compressor mounted in the casing, a housing containing and substantially isolating the inner passages or cavities of the motor from the casing cavity, a refrigerant suction port in the casing, a stationary liquid-gas separator in the casing having a wall defining a generally circular chamber communicating substantially tangentially with the suction port, a primary outlet in a radially central portion of the separator and a secondary outlet in a peripheral portion thereof, a primary-feed conduit connecting the primary outlet to the intake of the compressor, a secondary-feed conduit connecting the secondary outlet to the intake of the compressor and includes the passages between the housing, rotor and stator of the electric motor, and a refrigerant discharge port in the casing communicating with the compression chamber of the compressor.

5 Claims, 2 Drawing Sheets

REFRIGERANT GAS COMPRESSOR UNIT

This invention concerns a gas compressor unit of the type employed for refrigeration or air-conditioning systems, wherein the unit is electrically powered and hermetically sealed, and particularly concerns novel structural design which affords substantial improvements in operating characteristics such as compressor efficiency, motor cooling and liquid-slugging minimization.

Such units as employed, for example, in central air conditioners and window unit air conditioners, are required to provide highly compressed refrigerant gas in a thermodynamically efficient manner while providing the necessary cooling of their motors, compressors, and other parts, by virtue of their own structural designs and the thermodynamics of their associated closed-loop systems, all in an environment which lends itself to the formation of liquid refrigerant in the compressor intake system, leading to the well known liquid-slugging problems.

It is known, in a general way, to employ the refrigerant itself, or the oil of the compressor to cool the electric motor, as taught, for example, in U.S. Pat. Nos.: 2,963,216; 3,270,952; and 3,663,127 wherein a portion of the return or suction refrigerant, or the oil is caused to flow around various portions of the motor to cool the same. These disclosures are exemplary of the structures and of the gas flow or oil flow patterns which have been worked out in an attempt to provide proper motor cooling while, coincident therewith, paying necessary attention to potential liquid-slugging problems as well as the thermodynamic considerations affecting compressor efficiency and the like. The interactions of compressor structure and operation are thus extremely complex and have given rise to a wide variety of structural concepts, as exemplified in the aforesaid patents, in attempt to achieve the principal desirable operating characteristics of high compressor and overall system efficiency, adequate motor cooling and minimal liquid-slugging.

These prior compressor unit designs have had only limited success in attaining those goals, particularly with respect to maintaining the compressor feed gas at a sufficiently low temperature to provide a molecular density of the gas sufficiently high to allow proper compressor and overall system efficiency, without excessive liquid-slugging. It is a principal object therefore, of the present invention to provide a compressor unit construction which provides the aforesaid desirable operation characteristics without the need for complex, expensive structure.

This and other objects hereinafter appearing have been attained in accordance with the present invention which is defined in its broad sense as a refrigeration gas compressor unit comprising a casing, an electric motor driven compressor mounted in said casing, a housing containing and substantially isolating the inner cavities or passages of the motor from the casing cavity, refrigerant suction port means in said casing, stationary liquid-gas separator means in said casing comprising wall means defining a generally circular chamber communicating substantially tangentially with said suction port means, primary outlet means in a radially central portion of said separator means and secondary outlet means in peripheral portions thereof, primary-feed conduit means connecting said primary outlet means to the intake of said compressor, secondary-feed conduit means connecting said secondary outlet means to the intake of said compressor and comprising the passages between the housing, rotor and stator of said electric motor, and refrigerant discharge port means in said casing communicating with the compression chamber of said compressor.

In certain preferred embodiments of the invention:

liquid refrigerant drain ports are provided in a lower portion of said secondary-feed conduit means communicating with the casing cavity;

centrifuge means is provided in said secondary-feed conduit means proximate said drain ports for separating refrigerant liquid from gas; and the centrifuge means comprises fin means mounted on and rotatable with the electric motor rotor.

Further understanding of the present invention and preferred embodiments thereof will become apparent from the following description and drawings wherein.

Figure 1:
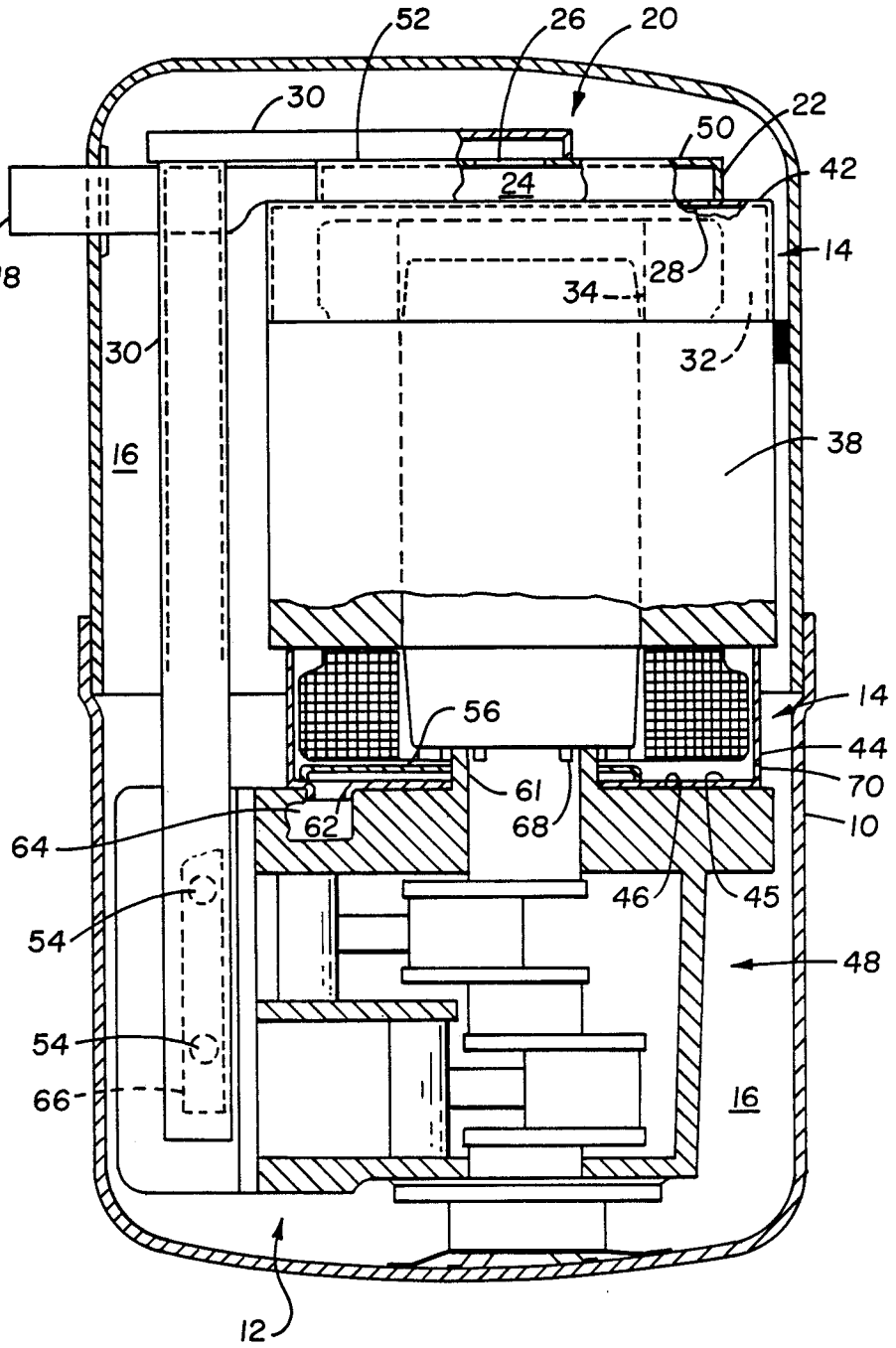
FIG. 1 is a side view, partially in section of the present compressor unit.

Referring to the drawing the dual piston compressor unit shown therein for exemplary purposes only, comprises a casing 10, an electric motor driven compressor generally designated 12 mounted in said casing, a housing generally designated 14 containing and substantially isolating the inner cavities and passages of the motor from the casing cavity 16, refrigerant suction port means 18 in said casing, stationary liquid-gas separator means generally designated 20 in said casing comprising wall means 22 defining a generally circular chamber 24 communicating substantially tangentially with said suction port means, primary outlet means 26 in a radially central portion of said separator means and secondary outlet means 28 in peripheral portions thereof, primary-feed conduit means 30 connecting said primary outlet means to the intake of said compressor, secondary-feed conduit means connecting said secondary outlet means to the intake of said compressor and comprising the passages 32, 34 and the like between the housing 14, rotor 36 and stator 38 of said electric motor, and refrigerant discharge port means 40 in said casing communicating with the compression chamber of said compressor.

The general construction of the compressor unit casing, electric motor, compressor, and other typically employed components can be of any conventional type, such as shown for example in the aforesaid U.S. patents and others such as U.S. Pat. Nos. 3,081,935 and 3,104,051, the disclosures of all of which are incorporated herein by reference. As will hereinafter become evident, modifications of these prior units can readily made by one skilled in the art in accordance with the present specification and drawings, in order to accommodate the present invention.

Referring further to the drawings, a top cover 42 is provided to cover the upper end of the motor, and a bottom cover or shroud 44 covers the lower end of the motor. This shroud may be conveniently formed in one piece and clamped between the stator 38 and the top 46 of the compressor shell generally designated 48. These covers, in cooperation with the stator itself provide the housing 14 which substantially isolates or seals the aforementioned motor inner cavities or passages such as 32 and 34 from the compressor unit casing cavity 16 and thereby allows directional control of refrigerant flow in accordance with the present invention as will be explained in greater detail below.

The liquid-gas separator generally designated 20 of cap-like configuration, comprising the generally circular wall 22 and top 50 providing the chamber 24 is affixed in any suitable manner such as welding or brazing to the top 52 of cover 42 when these components are metal, and by snap-in tabs or plastic fusion (welding) or the like when the components are of plastic material such as Nylon, cellulose acetate butyrate, polyester, or polycarbonate. The term "generally circular" as used herein means a configuration such as a circle, ellipse or the like which can direct the refrigerant flow in a centrifugal or swirling manner. The suction port means or tube 18 is sealed into an opening in wall 22 in a substantially tangential manner such as to cause the incoming liquid-gas return refrigerant to flow in a vortex-like manner and throw the heavier liquid radially outwardly toward wall 22. An aperture 26 in the cover 50 of the separator provides the primary outlet means and enters into conduit 30 affixed to top 50 to provide the primary-feed conduit means which is fixed at its lower end to a portion of the compressor so as to communicate with the intake valving 54 or other such intake porting system thereof to supply separated gas thereto. A plurality of apertures 28 in the top 52 of cover 42 are suitably placed as desired to overlie end portions of the stator core, windings or even further radially inwardly adjacent the rotor-stator gap, to allow the downward flow of separated liquid through motor passages and cavities such as 32 and 34 to thereby provide, in conjunction with said passages, the secondary-feed conduit means for cooling the motor.

Figure 3:
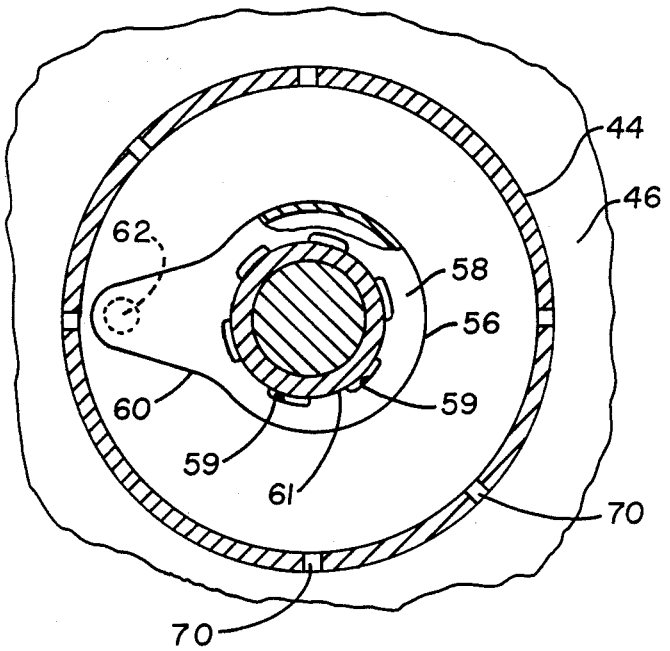
FIG. 3 is a sectional view of FIG. 2 taken along line 3—3 thereof in the direction of the arrows.
Figure 2:
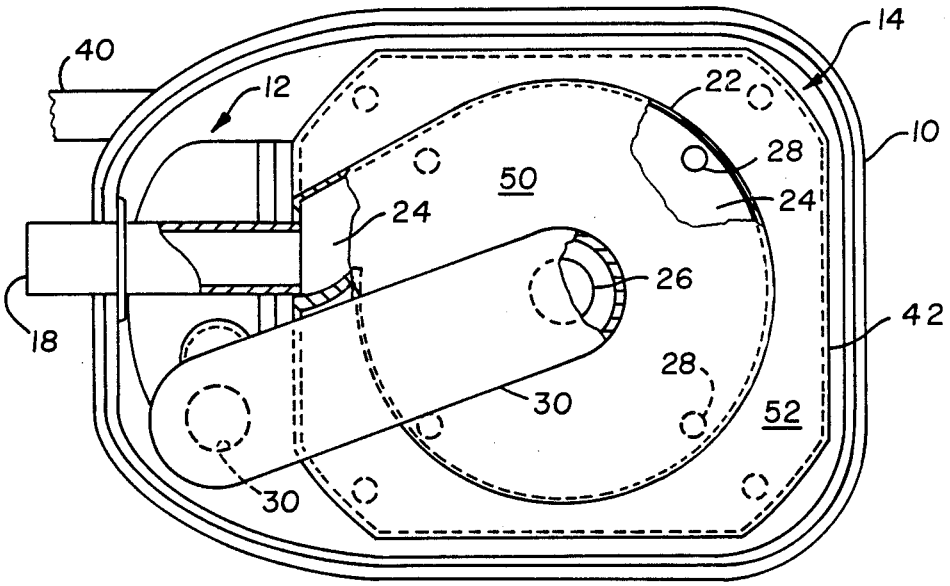
FIG. 2 is a vertically downward view of the unit of FIG. 1 with the top of the casing removed to show the arrangement of the liquid-gas separator means partially in section.

Referring particularly to FIG. 3, positioned on the floor 45 of shroud 44 and secured thereto in substantially sealing contact therewith is a gas inlet plenum 56 having an upper surface 58 for liquid run-off, gas inlet ports 59 spaced around the shaft bearing 61, and a gas transfer conduit 60 having bottom outlet 62 communicating with a suitable conduit segment such as internal passage 64 conveniently formed by casting or machining into the compressor shell 48. This segment is connected into an exterior conduit segment 66 which is connected into the primary-feed conduit 30 adjacent the compressor inlet porting system, thereby completing the secondary-feed conduit means. It is noted that passage 64 may equally well constitute an opening through the shroud 44. The end of the rotor is provided with a plurality of fins 68 which fling liquid refrigerant and any oil which is present outwardly toward a plurality of drain ports 70 spaced around the bottom edge of shroud 44. It is particularly noted that ports 59 are radially inboard of fins 68 and are thus essentially inaccessible to liquid materials flowing downwardly between the rotor and stator.

The operating conditions of the present unit in regard to refrigerant type and charge, oil level, compressor motor speed, and the like are conventional. The amount of gas taken off from the separator and fed directly to the compressor can be varied as desired by selecting the size of the centrally located outlet 26 in conjunction, for example, with the separator size and design, and the inlet refrigerant velocity and volume. It is desirable that at least about 50% of the gas be taken from the separator for direct feed to the compressor, preferably from about 70% to about 80%, and most preferably about 75%. The present construction gives many advantages, some of which are not readily apparent, and include the use of the vaporization of liquid refrigerant fed from the separator to the secondary-feed conduit, for cooling the motor, the gas thus formed then being fed to the compressor intake while the remaining liquid is separated out and drained to the sump. Such a concept is not taught by the aforesaid prior systems.

The invention has been described in detail with particular reference to preferred embodiments thereof, but it will be understood that variations and modifications will be effected within the spirit and scope of the invention.

I claim:

1. A refrigeration gas compressor unit comprising a casing, an electric motor driven compressor mounted in said casing, a housing containing and substantially isolating the inner cavities or passages of the motor from the casing cavity, refrigerant suction port means in said casing, stationary liquid-gas separator means in said casing comprising wall means defining a generally circular chamber communicating substantially tangentially with said suction port means, primary outlet means in a radially central portion of said separator means and secondary outlet means in a peripheral portion thereof, primary-feed conduit means connecting said primary outlet means to the intake of said compressor, secondary-feed conduit means connecting said secondary outlet means to the intake of said compressor and comprising the passages between the housing, rotor and stator of said electric motor, and refrigerant discharge port means in said casing communicating with the compression chamber of said compressor.

2. The unit of claim 1 wherein liquid refrigerant drain ports are provided in a lower portion of said secondary-feed conduit means communicating with the casing cavity.

3. The unit of claim 2 wherein centrifuge means is provided in said secondary-feed conduit means proximate said drain ports for separating refrigerant liquid from gas.

4. The unit of claim 3 wherein said centrifuge means comprises fin means mounted on and rotatable with the electric motor rotor.

5. The unit of claim 4 wherein a gas inlet plenum is provided in said secondary-feed conduit means adjacent the compressor end of said rotor and having inlet ports located radially inwardly of said fins.

* * * * *